US008349052B2

(12) United States Patent
Noh et al.

(10) Patent No.: US 8,349,052 B2
(45) Date of Patent: Jan. 8, 2013

(54) ELECTRIC PRECIPITATOR AND ELECTRODE THEREOF

(75) Inventors: Hyong Soo Noh, Suwon-si (KR); Kochiyama Yasuhiko, Seongnam-si (KR); Jun Ho Ji, Namyangiu-si (KR); So Young Yun, Suwon-si (KR); Han Wook Cho, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 537 days.

(21) Appl. No.: 12/585,009

(22) Filed: Aug. 31, 2009

(65) Prior Publication Data

US 2010/0132562 A1 Jun. 3, 2010

(30) Foreign Application Priority Data

Dec. 1, 2008 (KR) ..... 10-2008-120557

(51) Int. Cl.
*B03C 3/12* (2006.01)
*B03C 3/47* (2006.01)

(52) U.S. Cl. ..... 95/79; 96/69; 96/79; 96/99

(58) Field of Classification Search ..... 96/69, 77–79, 96/86, 87, 98–100; 95/79
See application file for complete search history.

(56) References Cited

U.S. PATENT DOCUMENTS

| | | | | |
|---|---|---|---|---|
| 3,950,153 | A * | 4/1976 | Von Berckheim | 96/78 |
| 4,313,741 | A * | 2/1982 | Masuda et al. | 96/78 |
| 4,569,684 | A * | 2/1986 | Ibbott | 96/79 |
| 4,652,281 | A * | 3/1987 | Masuda et al. | 96/69 |
| 5,137,552 | A * | 8/1992 | Sasaki | 96/80 |
| 6,117,216 | A * | 9/2000 | Loreth | 96/62 |
| 6,527,834 | B1 * | 3/2003 | Jorder et al. | 96/68 |
| 6,635,106 | B2 * | 10/2003 | Katou et al. | 96/67 |
| 6,852,149 | B2 * | 2/2005 | Huang | 96/79 |
| 7,081,155 | B2 * | 7/2006 | Loreth | 96/69 |
| 2004/0226448 | A1 * | 11/2004 | Griffiths et al. | 96/67 |

FOREIGN PATENT DOCUMENTS

| | | | |
|---|---|---|---|
| JP | 58-160747 | A * | 9/1983 |
| JP | 07-284692 | | 10/1995 |
| JP | 2002-126576 | | 5/2002 |

* cited by examiner

*Primary Examiner* — Richard L Chiesa
(74) *Attorney, Agent, or Firm* — Staas & Halsey LLP

(57) ABSTRACT

An electric precipitator prevents dielectric breakdown by ensuring the dielectric distance among a plurality of electrodes. The electric precipitator includes a charging section for charging dust particles in air, and a collecting section for collecting the dust particles charged by the charging section. The collecting section includes a high voltage electrode having a conductive layer coated with a dielectric layer, and a low voltage electrode having at least one protrusion that maintains a gap between the high voltage electrode and the low voltage electrode. The conductive layer includes at least one cutting part formed in an area corresponding to the protrusion.

17 Claims, 9 Drawing Sheets

(a)

(a)

(b)

(a)

(b)

(a)

(b)

ELECTRIC PRECIPITATOR AND ELECTRODE THEREOF

CROSS-REFERENCE TO RELATED APPLICATIONS

This application claims the benefit of Korean Patent Application No. 10-2008-0120557, filed on Dec. 1, 2008, in the Korean Intellectual Property Office, the disclosure of which is incorporated herein by reference.

BACKGROUND

1. Field

The disclosure relates to an electric precipitator. More particularly, the disclosure relates to an electric precipitator capable of preventing dielectric breakdown by ensuring the dielectric distance among a plurality of electrodes.

2. Description of the Related Art

In general, an electric precipitator is installed in an air conditioning system to purify the air by collecting and removing contaminant such as dust contained in the air.

The electric precipitator mainly employs a two-stage electric precipitation scheme by separately providing a charging section and a collecting section. The collecting section forms an electric field by arranging a high voltage electrode and a low voltage electrode in parallel to each other.

However, if dust is accumulated on a surface of an electrode, electric current is instantaneously applied to the accumulated dust from a conductive electrode, so dielectric breakdown or discharge may occur between the electrodes. In this case, a loud sound caused by discharge may be generated.

In order to prevent such phenomenon, one surface or both surfaces of the collecting electrode are coated with insulating material. Further, a spacer or a protrusion is formed at one side of the high voltage electrode or the low voltage electrode to constantly maintain a gap between the high and low voltage electrodes.

When the high and low voltage electrodes are coated with plastic resin in the collecting section, the dielectric distance between the two electrodes is sufficiently ensured, so dielectric breakdown can be prevented. However, since the two electrodes are coated with the plastic resin, surface potential of the high voltage electrode may be reduced and surface potential of the low voltage electrode may be increased. Thus, space electric field strength may be reduced.

Further, if resistivity of the plastic resin found in the high and low voltage electrodes is reduced to solve such problems, electric current leaked through the spacer or the protrusion is increased. Thus, power supply output is increased, so power loss may occur.

SUMMARY

Accordingly, it is an aspect of the disclosure to prevent dielectric breakdown by ensuring the dielectric distance among a plurality of electrodes.

It is another aspect of the disclosure to prevent space electric field strength from being reduced by separately providing a conductive protrusion and a dielectric protrusion which maintain a gap among a plurality of electrodes.

Additional aspects and/or advantages of the disclosure will be set forth in part in the description which follows and, in part, will be apparent from the description, or may be learned by practice of the disclosure.

The foregoing and/or other aspects of the disclosure are achieved by providing an electric precipitator including a charging section for charging dust particles in air, and a collecting section for collecting the dust particles charged by the charging section. The collecting section includes a high voltage electrode having a conductive layer coated with a dielectric layer, and a low voltage electrode having at least one protrusion that maintains a gap between the high voltage electrode and the low voltage electrode. The conductive layer includes at least one cutting part formed in an area corresponding to the protrusion.

Further, the protrusion protrudes from a peripheral portion of the low voltage electrode toward a peripheral portion of the dielectric layer, and the cutting part is disposed at a peripheral portion of the conductive layer in correspondence with the protrusion.

Further, the protrusion is formed at a center portion of the low voltage electrode, and the cutting part is formed at a center portion of the conductive layer in correspondence with the protrusion.

Further, the low voltage electrode includes a conductive section integrally formed with the protrusion.

Further, the protrusion includes a conductive protrusion protruding from the conductive section, and a dielectric protrusion integrally formed with the conductive protrusion.

Further, at least a part of the protrusion has conductivity.

Further, the conductive section is provided as a metal film.

Further, the dielectric protrusion makes line contact with the dielectric layer.

Further, the protrusion is formed with a through hole that allows air to pass therethrough.

Further, a sectional area of the protrusion, which is formed in an air flow direction, is smaller than a sectional area of the protrusion, which is formed in a direction perpendicular to the air flow direction.

Further, the conductive layer is formed through carbon printing.

According to another aspect, there is provided an electric precipitator including a charging section for charging dust particles in air, and a collecting section for collecting the dust particles charged by the charging section. The collecting section includes a high voltage electrode having a conductive layer coated with a dielectric layer, and a low voltage electrode having at least one protrusion that maintains a gap between the high voltage electrode and the low voltage electrode, and a conductive section. The conductive layer includes at least one cutting part formed in an area corresponding to the protrusion. The protrusion includes a first part having conductivity and a second part having dielectric property.

Further, the first part is manufactured in a form of slurry including first conductive materials, a binder for improving bonding force of the first conductive materials, and second conductive material for preventing conductivity from being reduced due to the binder.

Further, the second part is manufactured in a form of slurry including dielectric materials and a binder for improving bonding force of the dielectric materials.

According to another aspect, there is provided an electrode of an electric precipitator. The electrode includes a high voltage electrode having a conductive layer coated with a plastic film, a low voltage electrode having a conductive section, at least one protrusion integrally formed with the conductive section to maintain a gap between the high voltage electrode and the low voltage electrode, and a cutting part formed in an area of the conductive layer that makes contact with the protrusion.

Further, the cutting part is formed at a peripheral portion or a center portion of the conductive layer.

BRIEF DESCRIPTION OF THE DRAWINGS

These and/or other aspects and advantages of the disclosure will become apparent and more readily appreciated from the following description of embodiments, taken in conjunction with the accompanying drawings of which.

DETAILED DESCRIPTION

Hereinafter, exemplary embodiments of the disclosure will be described in detail with reference to accompanying drawings.

Figure 1:
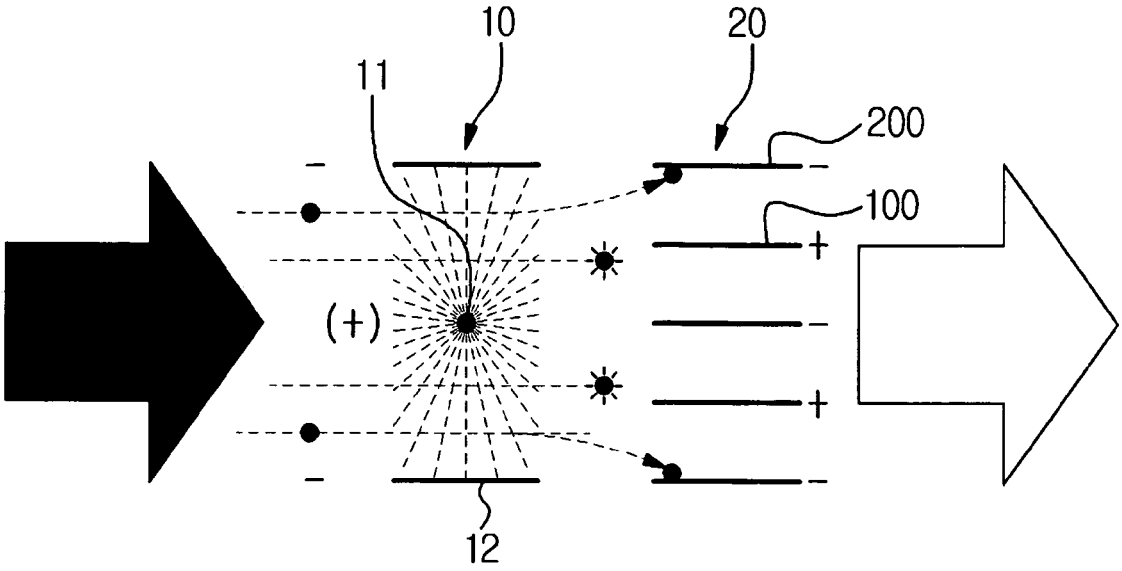
FIG. 1 is a view illustrating a basic principle of a two-stage electric precipitator according to an embodiment.
Figure 2:
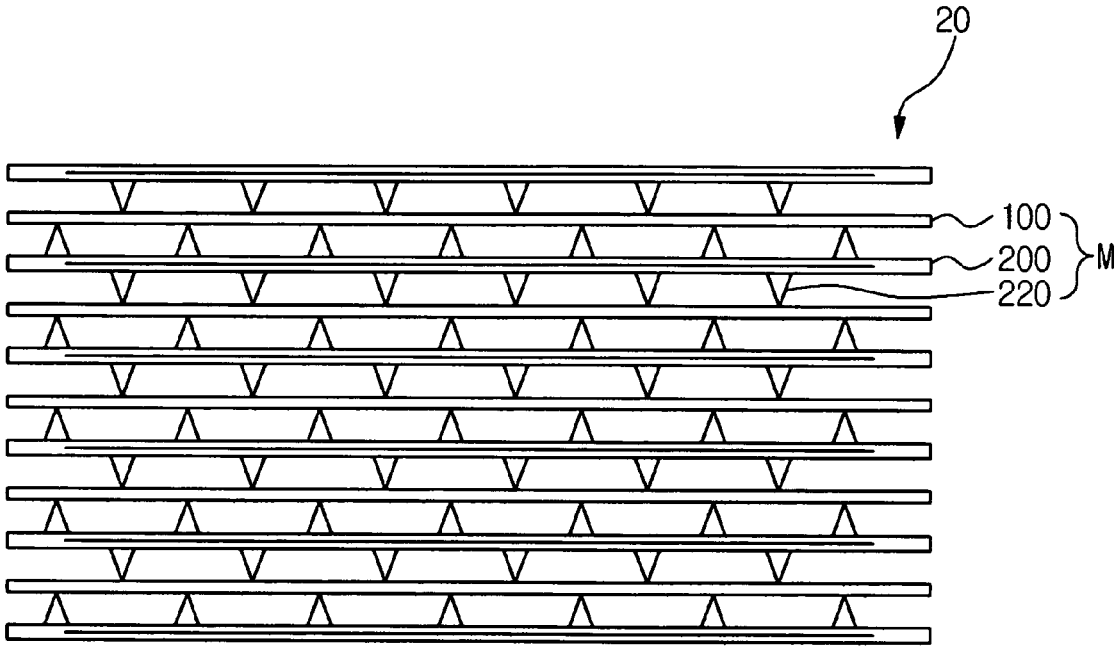
FIG. 2 is a sectional view illustrating a collection section of a two-stage electric precipitator according to an embodiment.

FIG. 1 is a view illustrating a basic principle of a two-stage electric precipitator according to an embodiment and FIG. 2 is a sectional view illustrating a collection section of the two-stage electric precipitator according to the embodiment.

As illustrated in FIGS. 1 and 2, the electric precipitator according to the embodiment includes a charging section 10 that electrolyzes dust in the air, and a collecting section 20 that collects dust particles charged by the charging section 10.

The charging section 10 includes a discharge line 11 having a thin wire shape made of tungsten material and serving as an anode, and a pair of opposite discharge plates 12 which are longitudinally arranged while being spaced apart from the discharge line 11 and serving as a cathode.

As high voltage is applied to the discharge line 11, electric current starts to flow due to the high potential difference between the discharge line 11 and the discharge pole plates 12, so corona discharge occurs. Thus, dust in the air flowing in the direction expressed by an arrow shown in FIG. 1 is charged. A plurality of discharge lines 11 and a plurality of discharge plates 12 may be installed at a predetermined interval while being arranged in parallel to each other.

The collecting section 20 is formed by alternately stacking high voltage electrodes 100 and low voltage electrodes 200 to collect the dust particles charged by the charging section 10.

As the high voltage is applied to the discharge line 11, the electric current starts to flow due to the high potential difference between the discharge line 11 and the discharge pole plates 12, so the corona discharge occurs. Thus, the dust particles in the air are charged with positive polarity. Then, the dust particles are collected in the low voltage electrodes 200 having voltage relatively lower than that of the high voltage electrodes 100.

Figure 3:
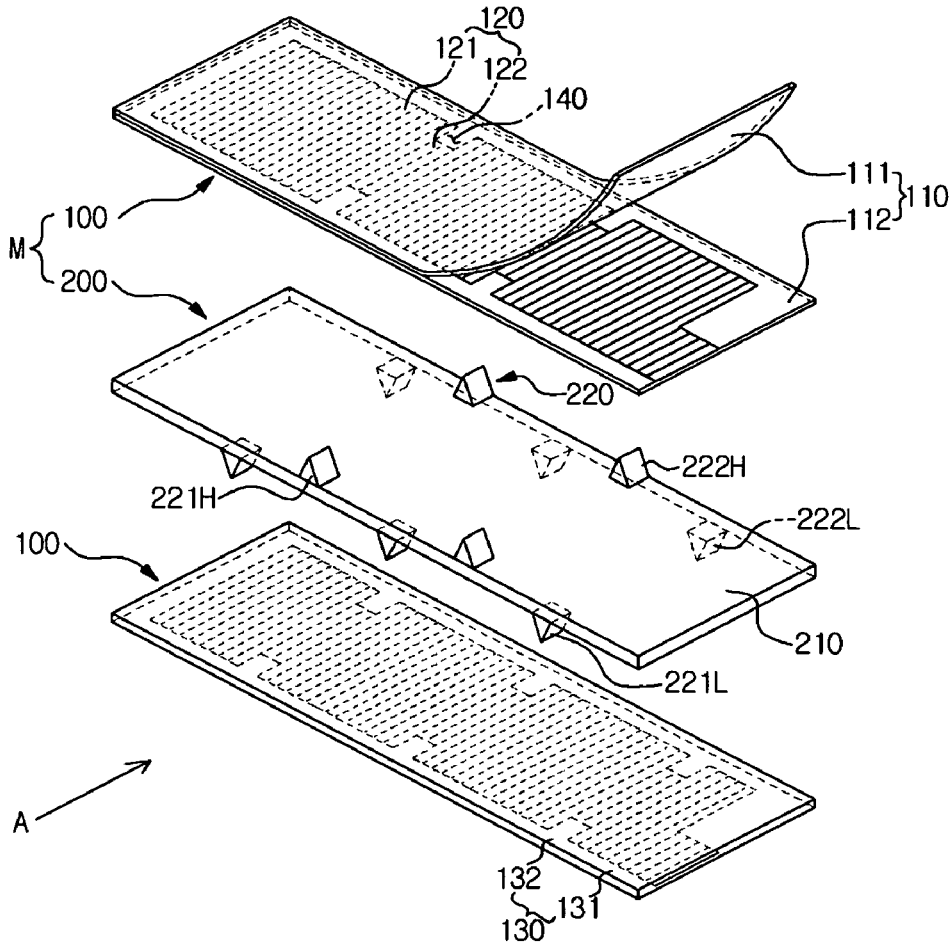
FIGS. 3(*a*) and (*b*) are perspective views illustrating an electrode according to a first embodiment.
Figure 3:
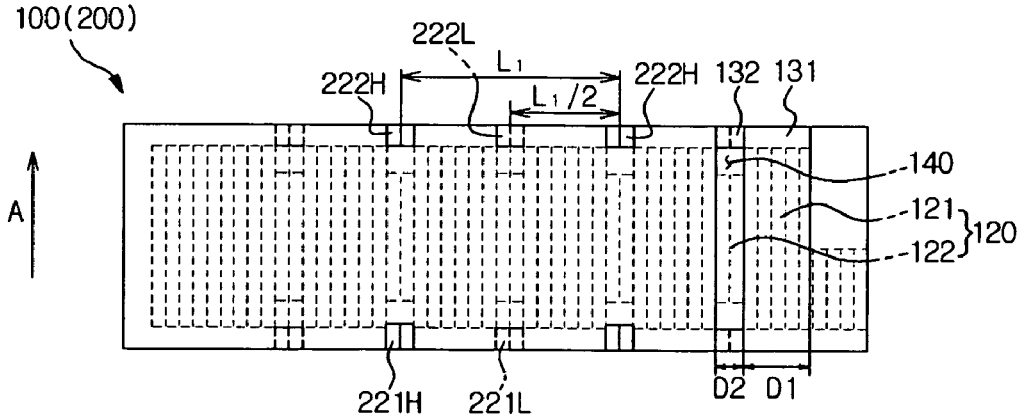

FIG. 3 is a view illustrating an electrode according to a first embodiment. As illustrated in FIG. 3, the electric precipitator according to the embodiment is formed by stacking collecting electrodes M that collect the dust particles charged by the charging section 10.

Each collecting electrode M includes the high voltage electrode 100, which has a conductive layer 120 coated with a dielectric layer 110, and the low voltage electrode 200 having a conductive section 210 which is not coated with a plastic film. Further, protrusions 220 are integrally formed with the conductive section 210 to maintain the gap between the high voltage electrode 100 and the low voltage electrode 200.

The dielectric layer 110 includes first and second rectangular dielectric layers 111 and 112 having the same sizes. A conductive layer 120 coated with conductive pigment is formed between the first and second dielectric layers 111 and 112. The conductive pigment includes material having superior electric conductivity such as metal or carbon. The dielectric layer 110 corresponds to an insulator and includes material having high volume resistivity and surface resistivity. The dielectric layer 110 can be prepared in the form of a plastic film.

The conductive layer 120 has a slightly smaller area than that of the first and second dielectric layers 111 and 112. In detail, the conductive pigment is not coated on a peripheral portion 130 of the high voltage electrode 100, which, in an embodiment, is formed at an edge of the high voltage electrode 100 with a width of from one to several millimeters. The peripheral portion 130 includes first peripheral portions 131, which do not make contact with protrusions 220, and second peripheral portions 132, which do make contact with the protrusions 220.

The low voltage electrode 200 is provided with the conductive section 210 coated with conductive pigment. The conductive section 210 includes material having superior electric conductivity. The conductive section 210 can be provided as one sheet of metal film such as stainless SUS or aluminum such that the conductive section 210 is not broken due to micro-discharge. In detail, the low voltage electrode 200 excludes an insulator such as plastic resin to prevent electric field strength from being reduced on a surface of the low voltage electrode 200. Thus, the low voltage electrode 200 has the same size as that of the high voltage electrode 100 to collect the dust particles charged with positive polarity.

The protrusions 220 are integrally formed with the low voltage electrode 200 to maintain the gap between the high voltage electrode 100 and the low voltage electrode 200. The protrusions 220 can be prepared in the form of plastic resin corresponding to an insulator. The protrusions 220 protrude from both surfaces of the conductive section 210 while being spaced apart from each other by a predetermined interval. The protrusions 220 closely make contact with the high voltage electrode 100, so that the gap between the high voltage electrode 100 and the low voltage electrode 200 can be maintained and the air can easily flow through a space among the protrusions 220.

Each protrusion 220 can be prepared in the form of a triangular protrusion that makes contact with the second peripheral portion 132. In detail, the triangular protrusion makes line contact with the high voltage electrode 100, so that a contact area between the high and low voltage electrodes 100 and 200 can be reduced.

The protrusions 220 include at least two upper protrusions, which protrude upward from the conductive section 210, and at least two lower protrusions which protrude downward from the conductive section 210. The upper protrusion includes a first upper protrusion 221H formed at a side of the conductive section 210 and a second upper protrusion 222H formed at an opposite side of the conductive section 210. Further, the lower protrusion includes a first lower protrusion 221L formed at the side of the conductive section 210 and a second lower protrusion 222L formed at the opposite side of the conductive section 210.

A plurality of the upper and lower protrusions 221H, 222H, 221L and 222L are arranged at both surfaces of the conductive section 210 to maintain the gap between the high voltage electrode 100 and the low voltage electrode 200. The distance $L_1$ between the upper protrusions 221H and 222H can be identical to the distance between the lower protrusions 221L and 222L.

The first upper protrusions 221H face the second upper protrusions 222H in parallel to each other, so the row and column of the first and second upper protrusions 221H and 222H can be formed. Similar to this, the first lower protrusions 221L face the second lower protrusions 222L in parallel to each other, so the row and column of the first and second lower protrusions 221L and 222L can be formed. The first and second lower protrusions 221L and 222L are positioned corresponding to the half of the distance $L_1$ between the upper protrusions 221H and 222H while being arranged in parallel to each other. Thus, the upper protrusions 221H and 222H making contact with the high voltage electrode 100 can be supported by the first and second lower protrusions 221L and 222L which make contact with the high voltage electrode 100 via the low voltage electrode 200.

Figure 4A:
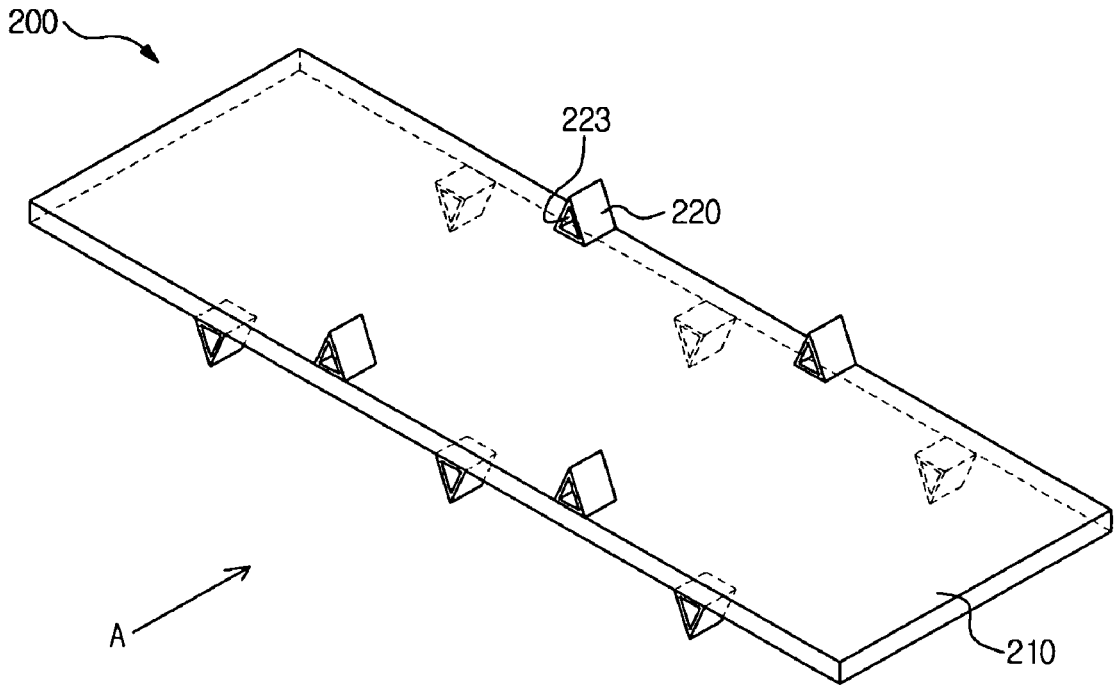
FIGS. 4A to 4C are perspective views illustrating various protrusions modified from a protrusion shown in FIG. 3.

FIG. 4 is a perspective view illustrating the protrusion having various shapes according to the embodiment. Each protrusion 220 shown in FIG. 4A is formed with a through hole 223, which is directed in the air flow direction A. In detail, a passage is formed in the protrusion 220, so the air can easily flow between the high voltage electrode 100 and the low voltage electrode 200.

Figure 4B:
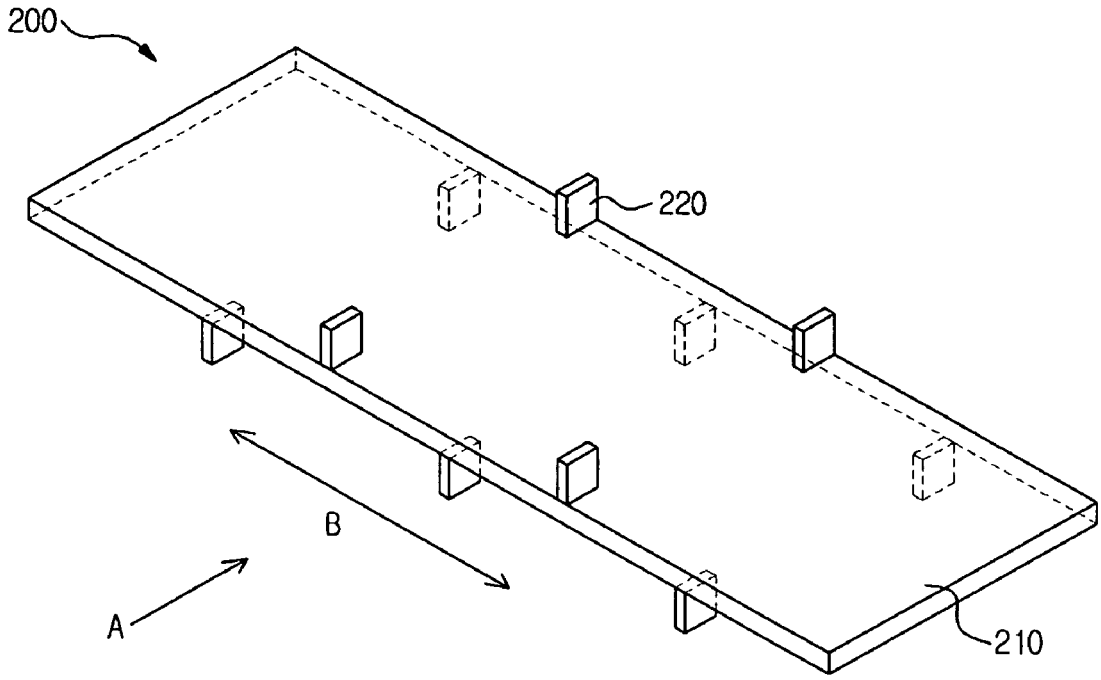

In the case of the protrusion 220 shown in FIG. 4B, a sectional area of the protrusion 220, which is formed in the air flow direction A, is smaller than a sectional area of the protrusion 220, which is formed in a direction B perpendicular to the air flow direction A, so that a contact area between the protrusion 220 and the air can be minimized. Thus, the air can easily pass through between the high voltage electrode 100 and the low voltage electrode 200 because collision between the air and the protrusion 220 can be minimized.

Figure 4C:
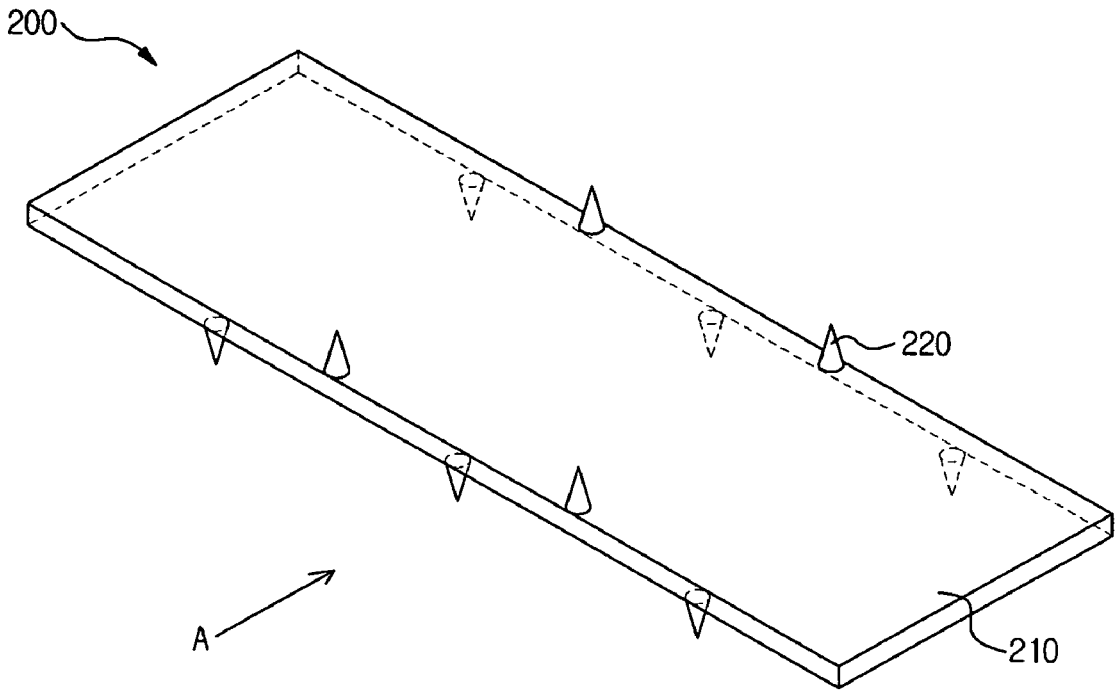

Each protrusion 220 shown in FIG. 4C has a conical shape such that a contact area between the protrusion 220 and the high voltage electrode 100 is minimized. Thus, the low voltage electrode 200 makes point contact with the high voltage electrode 100, so that the dielectric breakdown can be prevented.

Hereinafter, a coupling relation between the high and low voltage electrodes according to the embodiment will be described with reference to FIG. 3.

As shown in FIG. 3, the high voltage electrode 100 includes first areas D1, which have expansion surfaces 121 forming a large area of the conductive layer 120, and second areas D2 which have narrow surfaces 122 forming a small area of the conductive layer 120. The first and second areas D1 and D2 are alternately formed over the entire area of the high voltage electrode 100.

In each of the first areas D1, the first peripheral portion 131, the expansion surface 121 and the first peripheral portion 131 are sequentially formed in the air flow direction A. In each of the second areas D2, the second peripheral portion 132, a cutting part 140, the narrow surface 122, the cutting part 140 and the second peripheral portion 132 are sequentially formed in the air flow direction A. The cutting part 140 represents an area of the conductive layer 120, which is not coated with the conductive pigment.

Thus, in the high voltage electrode 100, the expansion surfaces 121 are alternately formed to maintain electric field strength by expanding the area of the conductive layer 120 coated with the conductive pigment, and the narrow surfaces 122 are alternately formed to prevent the dielectric breakdown by ensuring the dielectric distance between the high voltage electrode 100 and the low voltage electrode 200.

Figure 5:
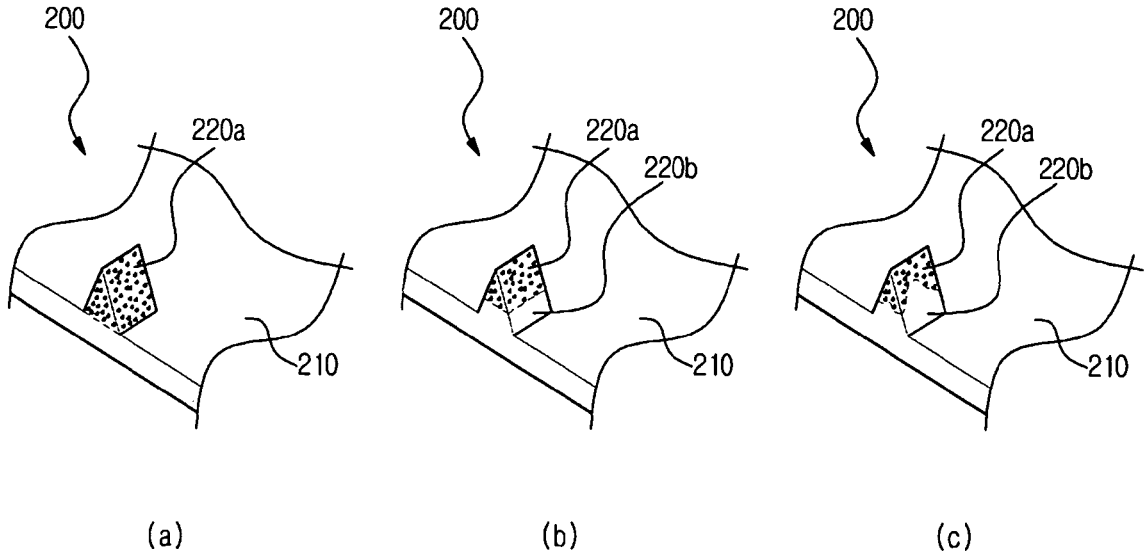
FIG. 5 is a perspective view illustrating various materials for a protrusion shown in FIG. 3.

FIG. 5 is a perspective view illustrating the protrusion of the low voltage electrode according to the embodiment. As shown in FIG. 5A, the protrusion 220 according to the embodiment includes only a dielectric protrusion 220*a* integrally formed with the conductive section 210.

As shown in FIGS. 5B and 5C, the protrusion 220 according to the embodiment includes a conductive protrusion 220*b* integrally formed with the conductive section 210 and having superior conductivity, and the dielectric protrusion 220*a* having superior dielectric property. The conductive protrusion 220*b* can be prepared in the form of slurry including conductive materials such as carbon, a binder for improving bonding force of the conductive materials, and conductive agent capable of improving conductivity while preventing the conductivity of the conductive protrusion 220*b* from being reduced due to the binder.

The dielectric protrusion 220*a* can be prepared in the form of slurry including good dielectric materials such as plastic resin, rubber and fiber, and a binder for improving bonding force of the dielectric materials. The conductive protrusion 220*b* and the dielectric protrusion 220*a* can vary depending on an interval between the high voltage electrode 100 and the low voltage electrode 200, and operating voltage.

Hereinafter, an operation of the electric precipitator according to the embodiment will be described.

First, dust particles charged due to corona discharge in the charging section 10 are introduced to the collecting section 20, to which a high electric field is applied, and then are collected on the surface of the low voltage electrode 200 before the dust particles pass through the collecting section 20 due to a Coulomb force.

Since the dust particles attached to the surface of the low voltage electrode 200 enter a flow boundary layer, the dust particles are rarely subject to shearing force caused by the flow of the dust particles, so the dust particles may be continuously attached to the surface of the low voltage electrode 200 without being easily separated from the surface of the low voltage electrode 200. In detail, in the collecting electrode M, the conductive layer 120 of the high voltage electrode 100 is disposed in parallel to the conductive section 210 of the low voltage electrode 200, so the electric field is formed between the high voltage electrode 100 and the low voltage electrode 200. Further, high voltage is applied to the high voltage electrode 100 and the low voltage electrode 200 is grounded to form the electric field, so the collecting electrode M functions as the collecting section 20 that collects the dust particles.

In particular, even when only the high voltage electrode 100 is coated with plastic resin and the low voltage electrode 200 is not coated with the plastic resin in order to maintain electric field strength, the dielectric distance is sufficiently ensured by the cutting parts 140, so that the dielectric breakdown can be prevented. Further, the protrusion 220, which maintains the gap between the high and low voltage electrodes 100 and 200, includes the conductive protrusion 220*b* having superior conductivity and the dielectric protrusion 220*a* having superior dielectric property, so that the space electric field strength can be prevented from being reduced.

Figure 6:
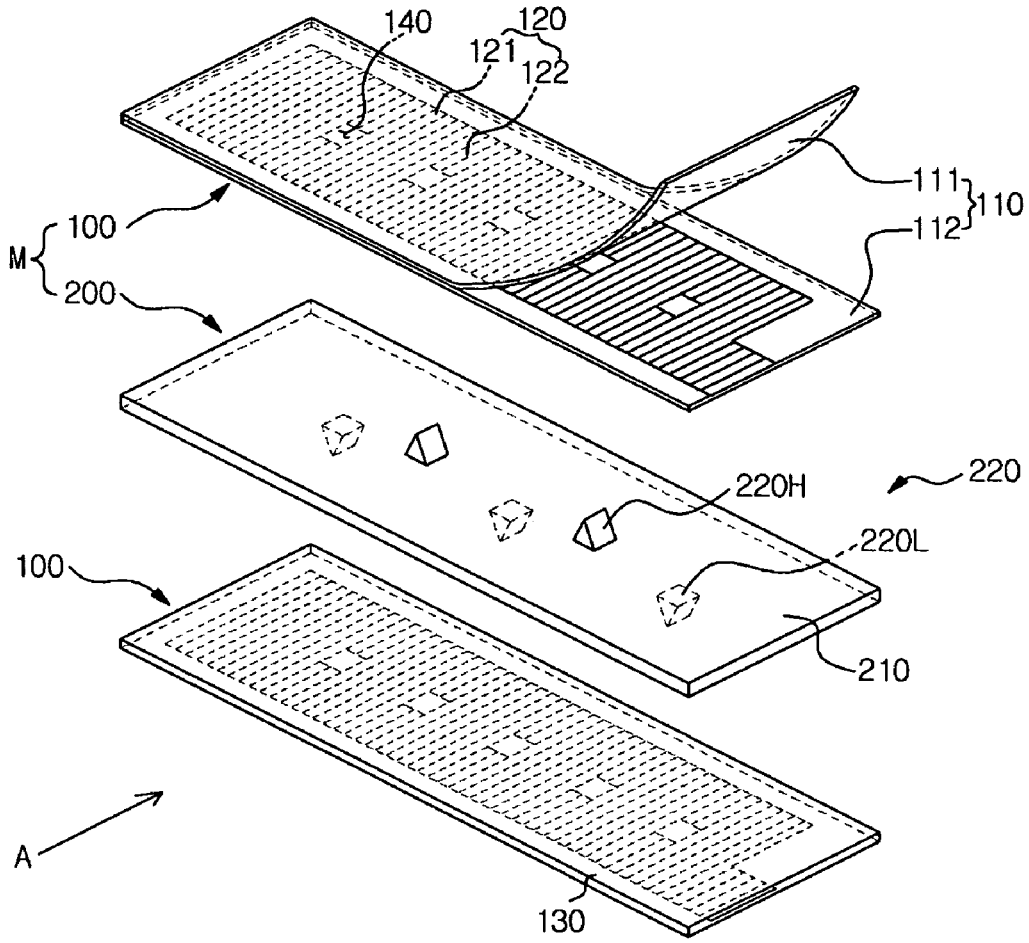
FIGS. 6(*a*) and (*b*) are perspective views illustrating an electrode according to a second embodiment.
Figure 6:
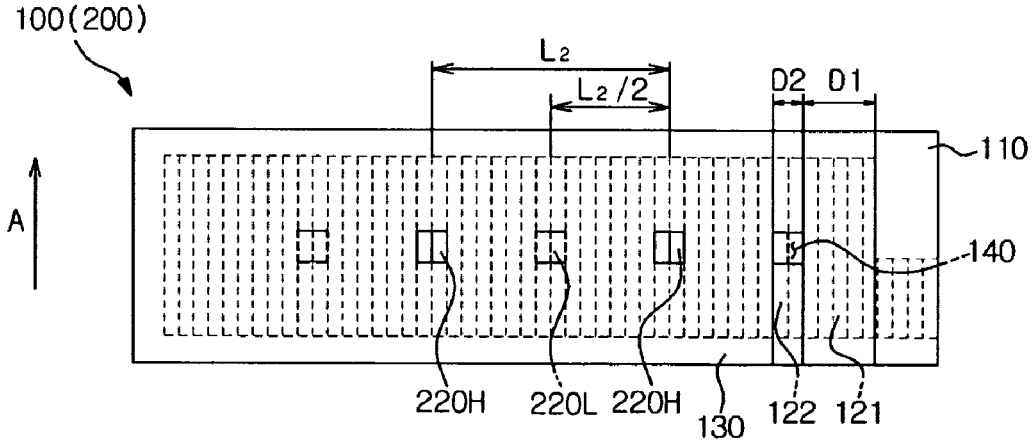

Hereinafter, a second embodiment will be described with reference to FIG. 6. The same reference numerals are used to designate the same elements as those of the first embodiment, and so a detailed description thereof will be omitted. FIG. 6 is a perspective view illustrating the collecting electrode according to the second embodiment.

Similar to the collecting electrode according to the first embodiment, the collecting electrode according to the second embodiment includes the high voltage electrode 100, which has the conductive layer 120 coated with the dielectric layer 110, and the low voltage electrode 200 having the conductive section 210 that is not coated with the dielectric layer 110. Further, the protrusions 220 are integrally formed with the conductive section 210 to maintain the gap between the high voltage electrode 100 and the low voltage electrode 200.

The positions of the protrusions 220 can be variously set to prevent droop of the high and low voltage electrodes 100 and 200 when the high and low voltage electrodes 100 and 200 are formed in a multilayer structure. For example, the protrusions 220 are formed at the center portion of the conductive section 210 to maintain the gap between the high and low voltage electrodes 100 and 200. The high voltage electrode 100 is provided at the center portion thereof with the cutting parts 140 having no conductive pigment. Each protrusion 220 includes upper protrusions 220H that protrude upward from the conductive section 210, and lower protrusions 220L that protrude downward from the conductive section 210.

A plurality of the upper and lower protrusions 220H and 220L are arranged at both surfaces of the conductive section 210 to maintain the gap between the high and low voltage electrodes 100 and 200. The distance $L_2$ between the upper protrusions 220H may be identical to the distance between the lower protrusions 220L. Further, the upper protrusions 220H are arranged in a row. The lower protrusions 220L may be positioned corresponding to half of the distance $L_2$ between the upper protrusions 220H while being arranged in a row.

Thus, the upper protrusions 220H making contact with the high voltage electrode 100 can be supported by the lower protrusions 220L which make contact with the high voltage electrode 100 via the low voltage electrode 200. Similar to the first embodiment, each protrusion 220 may have a triangular shape and may be formed with a through hole (not shown).

Figure 7:
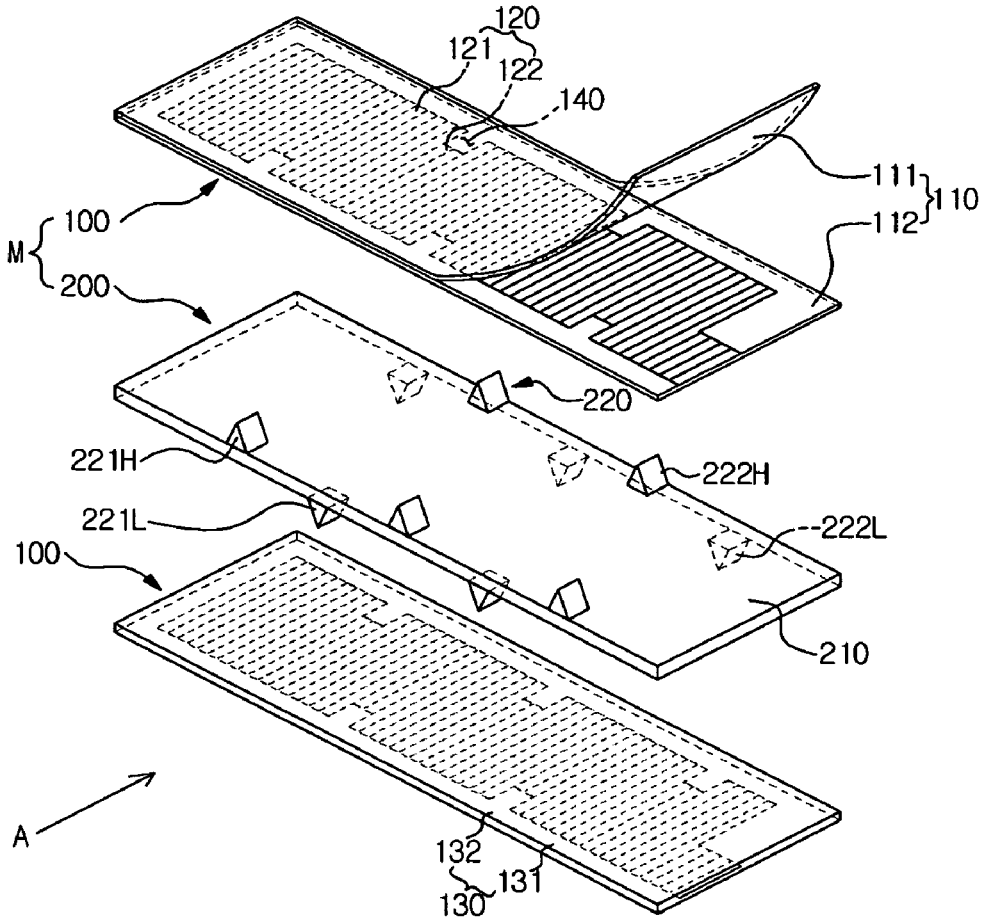
FIGS. 7(*a*) and (*b*) are perspective views illustrating an electrode according to a third embodiment.
Figure 7:
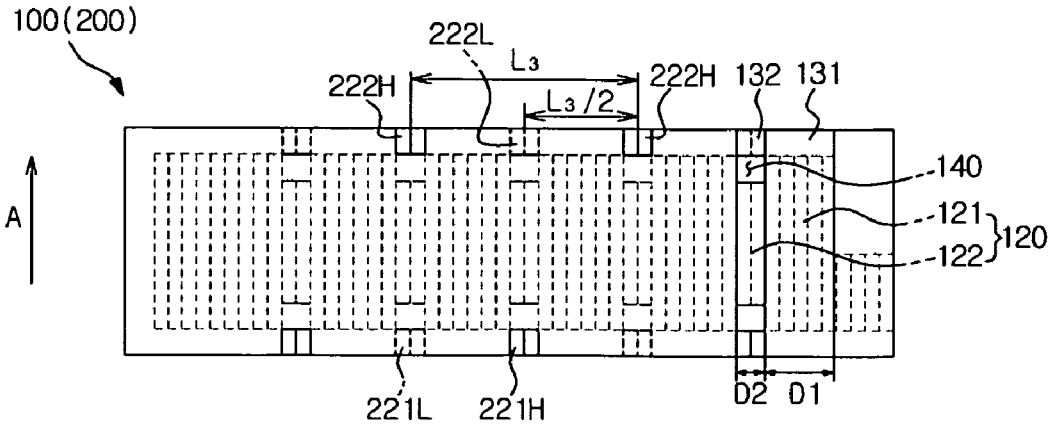

Hereinafter, a third embodiment will be described with reference to FIG. 7. The same reference numerals are used to designate the same elements as those of the first embodiment, and detailed description thereof will be omitted. FIG. 7 is a perspective view illustrating the collecting electrode according to the third embodiment.

Similar to the collecting electrode according to the first embodiment, the collecting electrode according to the third embodiment includes the high voltage electrode 100, which has the conductive layer 120 coated with the dielectric layer 110, and the low voltage electrode 200 having the conductive section 210 which is not coated with the plastic film. Further, the protrusions 220 are integrally formed with the conductive section 210 to maintain the gap between the high voltage electrode 100 and the low voltage electrode 200.

The high voltage electrode 100 includes the first areas D1, which have the expansion surfaces 121 forming a large area of the conductive layer 120, and the second areas D2 which have the narrow surfaces 122 forming a small area of the conductive layer 120. The first and second areas D1 and D2 are distinguished from each other depending on a contact state with the protrusions 220 and are alternately formed over the entire area of the high voltage electrode 100.

The protrusions 220 include upper protrusions, which protrude upward from the conductive section 210, and lower protrusions which protrude downward from the conductive section 210. The upper protrusions include first upper protrusions 221H, which closely make contact with the peripheral portion 130 of one side of the high voltage electrode 100, and second upper protrusions 222H which closely make contact with the peripheral portion 130 of an opposite side of the high voltage electrode 100. The lower protrusions include first lower protrusions 221L, which closely make contact with the peripheral portion 130 of one side of the high voltage electrode 100, and second lower protrusions 222L which closely make contact with the peripheral portion 130 of the opposite side of the high voltage electrode 100.

The first upper protrusions 221H are arranged to correspond to the second lower protrusions 222L while forming a row and column configuration. The first lower protrusions 221L are arranged to correspond to the second upper protrusions 222H while forming a row and column configuration. Further, the first and second lower protrusions 221L and 222L are positioned to correspond to half of the distance $L_3$ between the first and second upper protrusions 221H and 222H, while being arranged in a row, respectively.

Thus, the first and second upper protrusions 221H and 222H that make contact with the high voltage electrode 100 can be supported by the first and second lower protrusions 221L and 222L that make contact with the high voltage electrode 100 via the low voltage electrode 200. Similar to the first embodiment, each protrusion 220 may have a triangular shape and may be formed with a through hole 223.

As described above, in the electric precipitator, according to embodiments, the conductive layer of the high voltage electrode, which makes contact with the protrusions integrally formed with the low voltage electrode, is cut to form a cutting part to prevent the dielectric breakdown of the electrodes. Further, the protrusion that maintains the gap between the high and low voltage electrodes is divided into a conductive protrusion and a dielectric protrusion to prevent reduction of the space electric field strength. Thus, it would be appreciated by those skilled in the art that changes may be made in these embodiments without departing from the basic technology.

What is claimed is:

1. An electric precipitator comprising:

a charging section for charging dust particles in air; and a collecting section for collecting the dust particles charged by the charging section, wherein the collecting section comprises:

a high voltage electrode having a conductive layer coated with a dielectric layer; and a low voltage electrode having at least one protrusion that maintains a gap between the high voltage electrode and the low voltage electrode, wherein a portion of the conductive layer is coated with a conductive pigment and comprises at least one cutting part formed in an area corresponding to the protrusion, the cutting part being an area of the conductive layer that is not coated with the conductive pigment.

2. The electric precipitator of claim 1, wherein the protrusion protrudes from a peripheral portion of the low voltage electrode toward a peripheral portion of the dielectric layer, and the cutting part is disposed at a peripheral portion of the conductive layer that corresponds with the protrusion.

3. The electric precipitator of claim 1, wherein the protrusion is formed at a center portion of the low voltage electrode, and the cutting part is formed at a center portion of the conductive layer that corresponds with the protrusion.

4. The electric precipitator of claim 1, wherein the low voltage electrode comprises a conductive section integrally formed with the protrusion.

5. The electric precipitator of claim 4, wherein the protrusion comprises a conductive protrusion protruding from the conductive section, and a dielectric protrusion integrally formed with the conductive protrusion.

6. The electric precipitator of claim 1, wherein at least a part of the protrusion has conductivity.

7. The electric precipitator of claim 4, wherein the conductive section is provided as a metal film.

8. The electric precipitator of claim 5, wherein the dielectric protrusion makes line contact with the dielectric layer.

9. The electric precipitator of claim 1, wherein the protrusion is formed with a through hole that allows air to pass therethrough.

10. The electric precipitator of claim 1, wherein a sectional area of the protrusion, which is formed in an air flow direction, is smaller than a sectional area of the protrusion, which is formed in a direction perpendicular to the air flow direction.

11. The electric precipitator of claim 1, wherein the conductive layer is formed through carbon printing.

12. The electric precipitator of claim 1, wherein the at least one protrusion protrudes from the low voltage electrode and contacts the high voltage electrode at the cutting part.

13. An electrode of an electric precipitator, the electrode comprising:

a high voltage electrode having a conductive layer coated with a conductive pigment and a plastic film;

a low voltage electrode having a conductive section;

at least one protrusion integrally formed with the conductive section to maintain a gap between the high voltage electrode and the low voltage electrode; and a cutting part formed in an area of the conductive layer that is not coated with the conductive pigment and that makes contact with the protrusion.

14. The electrode of claim 13, wherein the cutting part is formed at a peripheral portion or a center portion of the conductive layer.

15. A collecting section of an electric precipitator for collecting dust particles charged by a charging section of the electric precipitator, the collecting section comprising:

a high voltage electrode having a conductive layer coated with a dielectric layer; and a low voltage electrode having a protrusion that maintains a gap between the low voltage electrode and the high voltage electrode, wherein a portion of the conductive layer is coated with a conductive pigment and includes a cutting part formed in an area corresponding to the protrusion, the cutting part being an area of the conductive layer that is not coated with the conductive pigment.

16. A method of preventing dielectric breakdown between a high voltage electrode comprising a conductive layer coated with a conductive pigment and a low voltage electrode, each electrode being included in an electric precipitator, the method comprising:

maintaining a gap between the low voltage electrode and the high voltage electrode by integrally forming at least one protrusion in the low voltage electrode; and forming a cutting part that is not coated with the conductive pigment in an area of the high voltage electrode corresponding to the at least one protrusion.

17. The method of claim 16, wherein the gap between the low voltage electrode and the high voltage electrode is maintained by forming the at least one protrusion to contact the high voltage electrode at the cutting part.

* * * * *

UNITED STATES PATENT AND TRADEMARK OFFICE

CERTIFICATE OF CORRECTION

PATENT NO. : 8,349,052 B2
APPLICATION NO. : 12/585009
DATED : January 8, 2013
INVENTOR(S) : Hyong Soo Noh et al.

It is certified that error appears in the above-identified patent and that said Letters Patent is hereby corrected as shown below:

On the Title Page, Item [75], Delete "Namyangiu-si" and insert -- Namyangju-si --, therefor.

Signed and Sealed this
Fourth Day of June, 2013

Teresa Stanek Rea
*Acting Director of the United States Patent and Trademark Office*